US007054589B2

(12) United States Patent
Okayasu et al.

(10) Patent No.: US 7,054,589 B2
(45) Date of Patent: May 30, 2006

(54) FIXING BELT HAVING A PROTECTIVE LAYER BETWEEN A METAL HEATING LAYER AND A RELEASING LAYER, MANUFACTURING METHOD THEREOF, AND ELECTROMAGNETIC INDUCTION HEAT-FIXING DEVICE USING THE FIXING BELT

(75) Inventors: Takahiro Okayasu, Minamiashigara (JP); Hitoshi Okazaki, Minamiashigara (JP); Makoto Omata, Minamiashigara (JP); Shigeo Ohta, Minamiashigara (JP); Hideaki Ohhara, Ashigarakami-gun (JP); Yasutaka Naito, Ashigarakami-gun (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/636,649

(22) Filed: Aug. 8, 2003

(65) Prior Publication Data

US 2004/0136762 A1 Jul. 15, 2004

(30) Foreign Application Priority Data

Aug. 9, 2002 (JP) ..... 2002-233554
Dec. 17, 2002 (JP) ..... 2002-365824

(51) Int. Cl.
*G03G 15/20* (2006.01)

(52) U.S. Cl. ..... 399/329

(58) Field of Classification Search ..... 399/329, 399/328, 333

See application file for complete search history.

(56) References Cited

U.S. PATENT DOCUMENTS

| | | | | |
|---|---|---|---|---|
| 5,724,638 | A * | 3/1998 | Isogai et al. | 399/333 |
| 6,246,035 | B1 * | 6/2001 | Okuda | 219/619 |
| 6,393,249 | B1 * | 5/2002 | Aslam et al. | 399/333 |
| 6,826,382 | B1 * | 11/2004 | Sanpei et al. | 399/328 |
| 6,898,388 | B1 * | 5/2005 | Uehara et al. | 399/69 |

FOREIGN PATENT DOCUMENTS

| | | | |
|---|---|---|---|
| JP | A 63-313182 | | 12/1988 |
| JP | 01260475 | A * | 10/1989 |
| JP | A 4-44074 | | 2/1992 |
| JP | A 5-299820 | | 11/1993 |
| JP | A 6-256960 | | 9/1994 |
| JP | A 6-316768 | | 11/1994 |
| JP | A 7-216225 | | 8/1995 |
| JP | A 11-352804 | | 12/1999 |
| JP | A 2000-188177 | | 7/2000 |
| JP | A 2001-341231 | | 12/2001 |

* cited by examiner

*Primary Examiner*—Quana Grainger
(74) *Attorney, Agent, or Firm*—Oliff & Berridge PLC

(57) ABSTRACT

The present invention provides a fixing belt including a substrate having provided thereon at least a metal heating layer and a releasing layer, wherein at least a protective layer is provided between the metal heating layer and the releasing layer, a manufacturing method thereof, and an electromagnetic induction heat-fixing device using the same.

24 Claims, 2 Drawing Sheets

FIXING BELT HAVING A PROTECTIVE LAYER BETWEEN A METAL HEATING LAYER AND A RELEASING LAYER, MANUFACTURING METHOD THEREOF, AND ELECTROMAGNETIC INDUCTION HEAT-FIXING DEVICE USING THE FIXING BELT

CROSS-REFERENCE TO RELATED APPLICATION

This application claims priority under 35 USC 119 from Japanese Patent Applications Nos. 2002-233554 and 2002-365824, the disclosures of which are incorporated by reference herein.

BACKGROUND OF THE INVENTION

1. Field of the Invention

The present invention relates to a heat-fixing belt in a device utilizing electrophotography, such as a copier or a printer. The present invention also relates to a manufacturing method thereof, and an electromagnetic heat-fixing device using the same.

2. Description of the Related Art

In an image forming device such as a copier or a printer employing an electrophotographic system, the process of fixing a toner image formed on a recording material such as paper to make a permanent image has been conventionally called a "fixing process". Conventional fixing processes include methods of press fixing, oven fixing, and solvent fixing, however, the thermal press fixing method has been most commonly used. This is due to the fact that the thermal press fixing method can effectively transmit heat and fix the toner image more firmly than other methods, and furthermore, it is comparatively safe.

The thermal press fixing method is a method in which a recording material having an unfixed toner image formed thereon is passed through a nip formed by two heated rolls or belts. The unfixed toner, which is heated by the rolls or belts and brought into a fused state when passed through the nip, is pressed onto the recording material and fixed thereto by the nip pressure.

The roll or the belt of a fixing member has a releasing layer provided on its surface, so as to have good separability and to prevent the surface from being fixed to the fused toner. Further, the roll or the belt is heated by a heating member in order to transmit heat to the toner image.

A method of heating the roll or the belt from inside the roll with the radiant heat of a halogen heater, which is provided in the roll, has been conventionally used. With this method, it takes much time to heat the surface of the roll to be heated to the point where the toner image can be fixed, because the roll is heated from the inside. For this reason, when a user copies or prints something, it is necessary to wait for the printed item. Moreover, in order to make the waiting time as short as possible, the surface of the fixing roll is continuously heated at a high temperature during standby so as to maintain a temperature that is lower than the fixing temperature. However, this method increases power consumption due to the standby heating, hence, the method does not satisfy the recent demand to provide energy-efficient machines.

Thus, a fixing device using a thin film and a fixed heater is taught utilizing an energy-saving fixing method in certain patent documents such as Japanese Patent Application Laid-Open (JP-A) Nos. 63-313182 and 4-44074. There has also been a widely used method of using a thin film belt as the fixing member, and heating the fixing member with a planar-resistant heating body arranged in the thin belt. In this method, as compared with the method of heating the roll from within the center, it is possible to shorten the fixing time because the belt can be heated without a heat insulation air layer, and further, the method does not require heating the center of the roll.

However, in the method using the above-mentioned belt and planar-resistant heating body, the planar-resistant heating body itself possesses a heat capacity, and it is difficult to shorten the time necessary to reach a fixing temperature to the point that the user does not feel a waiting time. It is also difficult to make the temperature distribution of the planar-resistant heating body uniform in the axial direction. Therefore, considering the current state of the above-mentioned method, sufficient energy conservation and high-quality image forming have yet to be achieved.

Meanwhile, a method of heating a fixing member with an induction heating system has been studied in recent years (e.g., JP-A Nos. 11-352804, 2000-188177). The heating principle of an electromagnetic induction heat-fixing system will be explained below.

The electromagnetic induction heat-fixing system requires not only a heat-fixing member and a press member, which are conventionally used, but also a coil and a high-frequency power source. The coil is arranged at a position inside the heat-fixing member or outside and near the heat-fixing member, and is electrically connected to the high-frequency power source. A metal heating layer in either the shape of a roll or a belt can be used as the heat-fixing member, which is heated by electromagnetic induction.

A high-frequency alternating current is passed through the coil from the high-frequency power source. At this time, magnetic flux is generated in the coil in a direction perpendicular to a plane wound by the coil corresponding to the direction of the current. The magnetic flux crosses the metal heating layer of the heat-fixing member arranged near the coil, generating an eddy current that in turn generates a magnetic field in a direction canceling this magnetic flux generated in the metal heating layer. Since the resistance of the metal heating layer is determined by the type of metal and the thickness thereof, the electric energy of the generated eddy current is converted to thermal energy. A fixing device using heat generated in this manner is referred to as an electromagnetic induction heat-fixing device.

In this method, the surface of the member to be heated can be heated effectively and thermally efficiently, making it possible to shorten the time necessary to reach a fixing temperature to an absolute minimum. As described above, the induction heat-fixing device includes a roll-type device and a belt-type device. In both types, by running a high-frequency current through the coil arranged near the member to be heated, an induced electromotive force is generated in the metal heating layer of the member, creating the eddy current that heats the member. In the roll-type device, a core metal can comprise the heating layer and be heated to a fixing temperature if an appropriate material is selected. The core metal material should be of a thickness capable of generating the eddy current with the coil, and heating the member with the eddy current. However, in the case of a roll-type device, it is the core metal that is heated, so the fixing temperature can be reached in a shorter time. This is because unlike conventional heating systems, there is no air layer, however, the core metal needs to have a thickness of several milli meters because it must possess rigidity. As a result, the core metal of the beating layer inevitably has a large heat capacity, which in turn increases the time it takes to heat the core metal. Accordingly, it is impossible to sufficiently shorten the time it takes to reach the fixing temperature.

Methods of forming a belt-type induction beat-fixing member include a method of using the metal heating layer as a substrate, and a method of forming a metal heating layer on a heat-resistant resin substrate. In the case of a belt using a metal heating layer as the substrate, the thickness of the substrate of the metal heating layer needs to be dozens μm to 200 μm thick because the substrate needs to be strong to a certain extent. This increases the heat capacity of the substrate, which increases the amount of time necessary to heat the surface of the belt, though not to the same extent as the roll-type device. Further, in order to form a nip with a press member and the belt, it is necessary to arrange a pressure applying member at a position opposite to the belt inside the belt. In many cases, a rubber pad is used as this pressure applying member because it forms the nip with the press member at a uniform pressure and ensures a nip width, however, this pad does not slide well against the metal substrate and is thus prone to intense deterioration.

Meanwhile, in the case of a belt using a substrate made of heat-resistant resin, engineering plastic having a heat resistance of 200° C. or more and having sufficient strength, such as polyimide or polyamide imide, is used. In this case, because the resin substrate ensures strength, the metal heating layer can be thinned as long as it can generate a sufficient amount of heat. Thus, in comparison with a belt having a metal substrate, it is possible to shorten the time it takes to reach the fixing temperature. Moreover, since the substrate is resin, it slides well against the pad inside the belt forming the nip.

The metal heating layer needs to be formed on the substrate in a uniform thickness. In certain cases, depending on the type of metal, the thickness of the layer can be decreased if the metal has low resistance, hence, it is possible to reduce the time it takes to reach the necessary fixing temperature. Generally speaking, metals such as copper, aluminum, and nickel are often used for the metal in the heating layer. Using these metals, a thin metal film can be formed on the heat-resistant resin with methods such as plating, vapor disposition, and sputtering. As described above, there is an optimum thickness, depending on the type of metal used, and the thinner the thickness, the less rigid the belt itself becomes. A thinner belt is more flexible, making it easier to form a suitable nip, thereby forming a fixed image of better quality. In addition, the heat capacity of a metal heating layer with a thinner film can be decreased, providing the advantage of shortening the time required to reach the necessary fixing temperature. It is therefore necessary to select a metal that has low resistance and that can heat despite being thin, and to form the metal film as thinly and uniformly as possible.

However, in the current state of art, there are certain problems with the fixing belt of the electromagnetic induction heating system in which the above-mentioned thin metal film layer is formed on the resin substrate. These problems relate to (1) the durability of the thin metal film layer and (2) the adhesiveness of the thin metal film layer to the resin substrate.

(1) Durability of the Thin Metal Film Layer

The thinner the film of the metal heating layer is, the less the heat capacity becomes, hence, the time required for the metal heating layer to reach the fixing temperature becomes shorter. Furthermore, the belt itself becomes more flexible which in turn improves the image quality, however, the strength of the metal heating layer decreases. Since the object is to use the belt for the induction heat-fixing device in order to fuse the toner on the recording material while applying pressure to the toner to firmly fix the toner to the recording material, the induction heat-fixing belt is used such that a nip load is pressed between the induction heat-fixing belt and the press members (e.g., press roll, press pad, press belt and the like) arranged at a position opposite to the induction heat-fixing belt. At this point, if the metal heating layer is thin, in some cases, the nip load necessary for fixing causes defects such as cracks or splits. Moreover, even when the nip load is low, the heating layer is passed through the nip many times causing repeated bending stress, and defects can occur in the metal heating layer such as cracks or splits.

When such defects are caused in the metal heating layer of the electromagnetic induction type heat-fixing member, the resistance of the heating layer is increased or the inside of the metal heating layer becomes electrically insulated, thus decreasing its heating capability. When the cracks do not become splits but rather groove-shaped defects, the thickness in those regions thins, which in turn causes abnormal in the same regions. This abnormal heating burns or fuses the separating layer coated on the surface, which drastically deteriorates the durability of the part.

Thus, as disclosed in JP-A No. 2001-341231, a proposition was made in which the substrate is endowed with flexibility to thereby reduce the mechanical stress applied to the metal heating layer by regulating the imidization rate of the polyimide resin layer.

However, depending on the stress, the proposition disclosed in JP-A No. 2001-341231 does not always eliminate the mechanical stress applied to the metal heating layer in the nip. In other words, simply making the substrate flexible does not sufficiently prevent the formation of cracks.

(2) Adhesiveness of the Metal Heating Layer to the Resin Substrate

Known methods of manufacturing a film-shaped member made by laminating a thin metal film on a heat-resistant resin layer include a method of bonding a heat-resistant resin film to a metal foil with an adhesive, and a method of forming a thin metal film on a heat-resistant resin film by chemical or physical plating.

However, the adhesion in the above-mentioned method of bonding a heat-resistant resin film to a metal foil with an adhesive is not reliable when the thin metal film is repeatedly heated with electromagnetic induction. Even in the method of forming a thin metal film on a heat-resistant resin, it is generally difficult to make the heat-resistant resin layer such as a polyimide or aromatic polyamide (aramid) firmly adhere to a thin metal film made from copper or the like.

In order to improve adhesion, JP-A No. 5-299820 proposes a technology where a metal vapor deposition film is formed on a polyimide, after which sequential lamination of a copper layer by electron beam heating vapor deposition and another copper layer by electrolytic plating is performed on the metal vapor deposition film.

Further, JP-A No. 6-316768 discloses a technology in which fluorine is included in the polyimide and then, in order to make this fluorine an adhesive site, the polyimide is first subjected to first etching by use of an aqueous solution containing hydrazine. Next, it is subjected to second eching with naphthalene-1-sodium, thereby making the copper adhere easily to the polyimide.

Still further, JP-A No. 7-216225 discloses a technology for enhancing the adhesiveness of a thin metal film to a polyimide by mixing powdered metal into a polyimide precursor.

Meanwhile, even in the case where the heat-resistant resin is an aromatic polyimide (aramid), JP-A No. 6-256960 proposes a technology that subjects aromatic polyimide to etching with an aqueous solution containing hydrazine and alkaline metal hydroxide, and then catalyzing to obtain non-electrolytic plating.

However, as described above, depending on the stress at the nip, the mechanical stress in the metal heating layer is not always eliminated by making the fixing member flexible, hence, the prevention of cracks cannot be sufficiently accomplished simply by making the fixing member flexible.

Still further, in order to obtain stable adhesion in the case where the heating layer is formed on the resin substrate of an insulator, the technologies disclosed in the above-mentioned patent publications do not provide sufficient adhesion and further, they require a complex manufacturing processes, which inevitably increases manufacturing costs.

Therefore, a fixing belt capable of more effectively and compatibly preventing cracks from mechanical stress and shortening of the warm-up time is necessary, as well as a manufacturing method thereof. Further, it is necessary to provide an electromagnetic induction heat-fixing device capable of preventing the deterioration of its heating capabilities, and of maintaining high image quality for a long time.

Still further, it is necessary to provide a fixing belt that improves adhesion to the metal heating layer and enhances durability, and to provide a manufacturing method thereof.

SUMMARY OF THE INVENTION

A first aspect of the present invention is to provide a fixing belt comprising a substrate having provided thereon at least a metal heating layer and a releasing layer, wherein at least a protective layer is provided between the metal heating layer and the releasing layer.

Further, a second aspect of the invention is to provide an electromagnetic induction heat-fixing device comprising: a fixing belt comprising a substrate having provided thereon at least a metal heating layer and a releasing layer; a press roll that abuts against the fixing belt to form a nip and rotates; a press contact member for increasing a nip pressure; and an excitation coil, wherein an eddy current is generated in the metal heating layer, which is included in the fixing belt, by a magnetic field generated by running an electrical current through the excitation coil to heat a surface of the metal heating layer, and a recording material having an unfixed toner image formed thereon is passed through the nip in such a way that the unfixed toner image abuts against the fixing belt to fuse the unfixed toner image and fix the image to the recording material by pressure, and wherein the fixing belt has at least a protective layer provided between the metal heating layer and the releasing layer.

Still further, a third aspect of the invention is to provide a method of manufacturing a fixing belt comprising a substrate having provided thereon at least a metal heating layer and a releasing layer, the method comprising: a step of forming a protective layer between the metal heating layer and the releasing layer; and a heat treatment step of heat-treating the protective layer at a temperature of 200° C. or more.

Still further, a fourth aspect of the invention is to provide a fixing belt comprising a substrate having provided thereon at least a metal heating layer and a releasing layer, wherein at least a thermoplastic resin layer is provided between the substrate and the metal heating layer.

Still further, a fifth aspect of the invention is to provide a method of manufacturing a fixing belt comprising a substrate having provided thereon at least a metal heating layer and a releasing layer, the method comprising: a step of forming a protective layer between the substrate and the metal heating layer; and a heat treatment step of heat-treating the protective layer at a temperature of 200° C. or more.

DETAILED DESCRIPTION OF THE INVENTION

Figure 1:
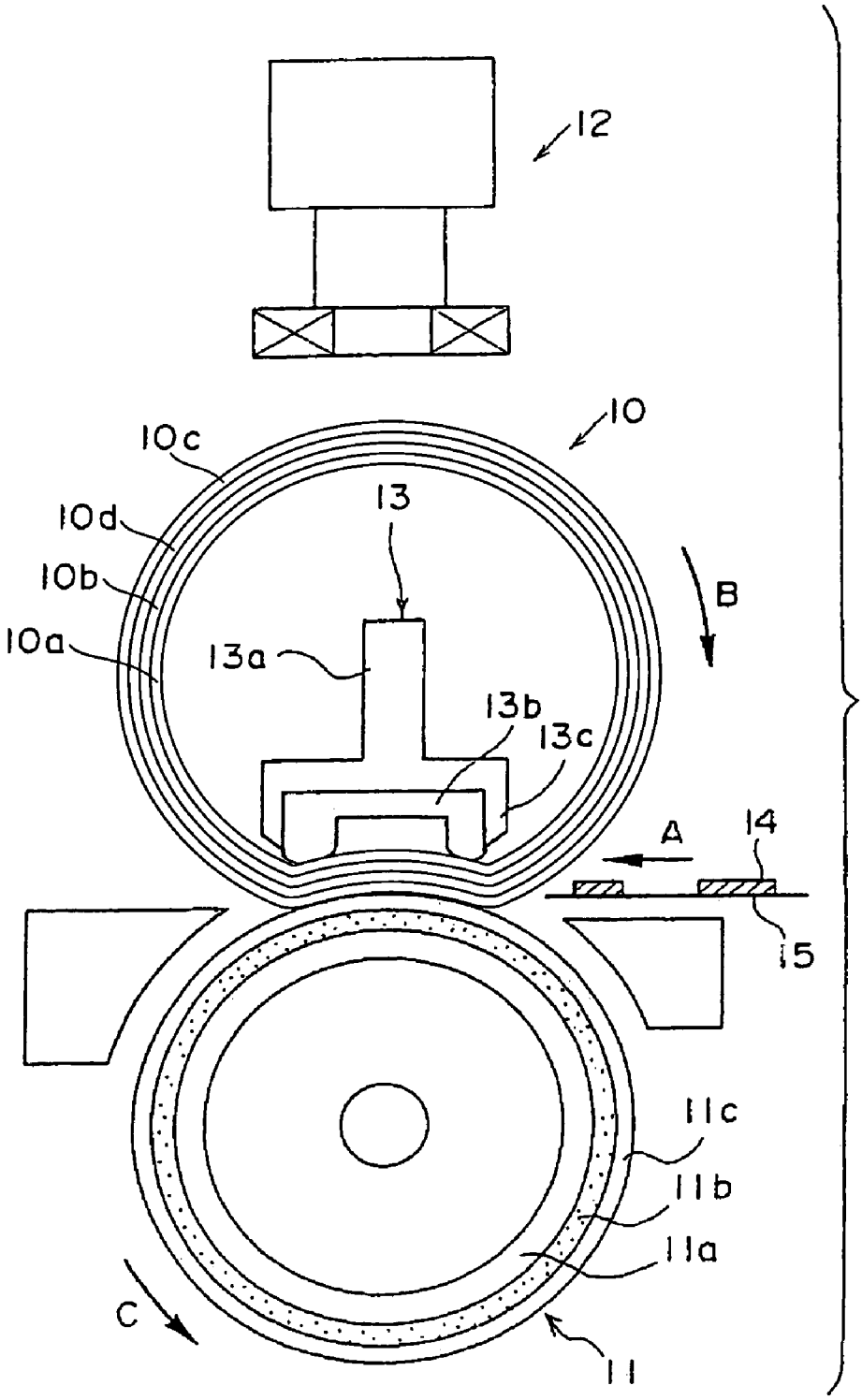
FIG. 1 is a cross sectional view showing a schematic construction of an electromagnetic induction heat-fixing device of the present invention using a fixing belt of the present invention.

The present invention will be hereinafter described in detail.

The fixing belt of the first aspect of the invention has at least a metal heating layer and a releasing layer on a substrate and has at least a protective layer provided between the metal heating layer and the releasing layer. Meanwhile, the fixing belt of the fourth aspect of the invention has at least a thermoplastic resin layer provided between the substrate and the metal heating layer.

[Substrate]

The substrate of the fixing belt of the invention is not limited, as long as it can be repeatedly turned in an electromagnetic induction heat-fixing device, which will be described later, physical properties thereof do not degrade at a fixing temperature and it has high strength. However, the substrate is preferably made from a heat-resistant resin.

When a metal substrate (metal film) is used in the invention, it is advantageous in that it firmly adheres to a thin metal film formed thereon. However, since it is difficult to ensure good sliding ability of a press member against the inner surface (substrate) of the heat-fixing belt in the electromagnetic induction heat-fixing device, the metal substrate sometimes damages the press member.

Meanwhile, use of the substrate made from the heat-resistant resin having a higher sliding ability in the invention makes it possible to reduce sliding resistance between the fixing belt and the press member and hence to lengthen life of the press member.

As described above, it is preferable that, in the heat-fixing member used in the invention, a metal heating layer, which will be described later, is formed on the surface of the substrate made from the heat-resistant resin.

Examples of the heat-resistant resin include resins having high heat resistance and high strength such as a polyimide, an aromatic polyimide, and a liquid crystal material such as a thermotropic liquid crystal polymer and the like, and the polyimide is most preferable among them.

The preferable thickness of the substrate in the invention is determined by the relationship between the thickness of the substrate and a protective layer, which will be described later, and preferably falls within a range where rigidity and flexibility enabling the fixing belt to be repeatedly turned can be compatibly established. That is, the substrate thickness preferably ranges from 10 μm to 200 μm, and more preferably ranges from 30 μm to 100 μm. If the thickness is smaller than 10 μm, rigidity is insufficient and hence the substrate sometimes becomes wrinkled or cracks at the edge portions of both ends thereof while the fixing belt is being turned. Conversely, if the thickness is larger than 200 μm, the substrate cannot be flexible in some cases.

[Metal Heating Layer]

In the fixing belt of the invention, the metal heating layer is usually a thin metal film layer and is a layer that generates an eddy current under a magnetic field generated by a coil to thereby produce heat in the electromagnetic induction heat-fixing device, and metal producing an electromagnetic induction effect is used for the metal heating layer. Such a metal can be selected from, for example, nickel, iron, copper, gold, silver, aluminum, steel, chromium and the like. Among them, in consideration of cost, heat generating properties and workability, copper, nickel, aluminum, iron and chromium are preferable and in particular, copper is most preferable.

The optimal thickness of the above-mentioned metal heating layer varies depending on the type of the metal used. For example, when copper is used for the metal heating layer, the thickness thereof preferably ranges from 3 μm to 50 μm, and more preferably ranges from 3 μm to 30 μm and still more preferably ranges from 5 μm to 20 μm.

If the thickness of the metal heating layer is smaller than 3 μm, the resistance of the metal heating layer increases, and it becomes difficult to generate a sufficient eddy current and heat is insufficiently generated, which in some cases lengthens a warm-up time or makes it impossible to heat the metal heating layer to the fixing temperature. Meanwhile, if the thickness of the metal heating layer is larger than 50 μm, the metal heating layer can generate sufficient heat but the heat capacity thereof increases and hence the warm-up time sometimes lengthens.

[Protective Layer]

As described above, the metal heating layer is usually the thin metal film layer and the strength thereof is very weak. Therefore, when the metal heating layer is repeatedly turned, it cracks and hence heat generating characteristics thereof degrades. This is due to the following reason. In a nip in the electromagnetic induction heat-fixing device, the belt is repeatedly deformed such that it becomes concave on its releasing layer side, which is the outermost layer, and conversely, becomes convex on its substrate side. At this time, the metal heating layer undergoes a tensile stress or a compressive stress caused by the force of the layer on the inner surface of the heating layer and the force of the layer on the outer surface of the heating layer. When these stresses exceed the strength of the heating layer, they cause the heating layer to crack, which degrades the electric characteristic and the heat generating characteristics of the heating layer.

More specifically, the substrate generally needs to have sufficient strength, and therefore is made from a material having a high elastic modulus and it is necessary that the thickness is about 10 μm to 100 μm.

In contrast, the releasing layer and, if necessary, an elastic layer are provided as the layer on or above the outer surface of the metal heating layer, but an elastic modulus of each of these layers is much lower than that of the substrate.

The stress pressed to the metal heating layer is determined by balance of the product of the elastic modulus and the thickness of the layer on the inner surface of the metal heating layer and that of the layer on the outer surface of the metal heating layer. As is usual with a conventional heat-fixing belt, when the layer on the outer surface of the metal heating layer is single layer made from a material having a low elastic modulus, the difference between the product of the elastic modulus and the thickness of the layer on the inner surface of the metal heating layer and that of the layer on the outer surface of the metal heating layer is large. Therefore, whenever the belt is deformed in the nip, the heating layer receives the tensile stress or the compressive stress.

In the heat-fixing belt of the invention, a protective layer is provided on the metal heating layer. Accordingly, the heat-fixing belt of the invention has at least the substrate as the layer on the inner surface of the metal heating layer and at least the protective layer and the releasing layer and, if necessary, an elastic layer as the layer on or above the outer surface of the metal heating layer.

When the above-mentioned construction is adopted as that of the heat-fixing belt, the releasing layer, the elastic layer and the like each have a much lower elastic modulus than the substrate the protective layer and the heating layer, and therefore the releasing layer and the elastic layer can be neglected in considering the balance of the elastic moduli. That is, if only the substrate, the protective layer, and the heating layer are taken into consideration, it is possible to consider the balance of elastic moduli. In other words, formation of the protective layer on the metal heating layer makes it possible to prevent the metal heating layer to crack.

Given that the thickness of the substrate is $t_a$, the elastic modulus of the substrate is $E_a$, the thickness of the protective layer is $t_b$, and the elastic modulus of the protective layer is $E_b$, it is preferable that the fixing belt of the invention satisfies the following equation (1)

$$0.05 \leqq \{(t_b \times E_b)/(t_a \times E_a)\} \leqq 1 \quad \text{[Equation (1)]}$$

In the fixing belt of the invention, in order to prevent deterioration of heat generating characteristics of the heating layer due to the occurrence of cracks, it is important that the tensile forces and/or the compressive forces of the protective layer and the substrate are substantially the same. If the tensile force and/or the compressive force of the substrate are substantially equal to those of the protective layer, the tensile forces and the compressive forces are unlikely to press to the metal heating layer. In order to make the tensile forces and the compressive forces of the protective layer and the substrate substantially the same, it is essential that a coefficient obtained by multiplying the elastic modulus and the thickness of the substrate together is substantially the same as that obtained by multiplying the elastic modulus and the thickness of the protective layer together. In such a case, the metal heating layer does not receive the stress. Most ideally, the coefficients are the same. However, this is not necessarily required depending on a use method or a required durability. It is sufficient that the fixing belt has a necessary durability and, as described above, it is preferable that the fixing belt meets the equation (1).

If $\{(t_b \times E_b)/(t_a \times E_a)\}$ is smaller than 0.05 in the equation (1), the protective layer may not sufficiently protect the metal heating layer. Meanwhile, if $\{(t_b \times E_b)/(t_a \times E_a)\}$ is larger than 1.0 in the equation (1), the warm-up time may increase. In addition, since the rigidity of the belt increases, micro gloss which is one of image quality may becomes uneven, offsetting may occur, or a rough image may be obtained.

It is preferable that $\{(t_b \times E_b)/(t_a \times E_a)\}$ in the equation (1) ranges from 0.20 to 1.0, more preferably from 0.25 to 1.0, and still more preferably from 0.5 to 1.0. If $\{(t_b \times E_b)/(t_a \times E_a)\}$ is within this range, it is possible to effectively prevent deterioration of the heat generating characteristics.

It is preferable that the elastic modulus $E_a$ of the substrate and the elastic modulus $E_b$ of the protective layer satisfy the following equation (2).

$$E_b \geqq E_a \quad \text{[Equation (2)]}$$

In consideration of quick start, namely short warm-up time, that is the largest advantage when the fixing belt of the invention is used in the electromagnetic induction heat-fixing device, it is preferable that the protective layer on the outer surface of the metal heating layer is a thin film. In order to make the protective layer as thin as possible, it is effective that $t_b$ is smaller than $t_b$ in the equation (1). Even in this case, in order to satisfy the equation (1), it is important that the protective layer is made from a material having a high elastic modulus. For example, use of a material having a higher elastic modulus than the material of the substrate as the protective layer material enables the resultant protective layer on the obverse surface side of the heating layer to be thin and have an equivalent protection effect as compared with a case where the protective layer is made from the same material as the material of the substrate, which in turn enables quicker start.

It is preferable that the thickness $t_b$ of the protective layer and the thickness $t_c$ of the metal heating layer satisfy the following equation (3).

$$10 \geqq t_b/t_c \geqq 1 \quad \text{[Equation (3)]}$$

If $t_b/t_c$ is smaller than 1, a sufficient effect cannot be obtained in some cases. Meanwhile, if $t_b/t_c$ is larger than 10, the rigidity of the whole fixing belt becomes too large and hence, an angle formed by a direction in which a sheet is separated from the fixing belt and a direction tangent to the circumference of the belt becomes small, which reduces the separability of the belt from the toner and therefore causes an offsetting phenomenon in some cases. Moreover, in some cases, the belt cannot sufficiently fit the toner image in the nip and hence, in particular, the color reproduction of a color image is damaged.

It is preferable that the elastic modulus of the protective layer used in the invention is at least 2 Gpa, and preferably at least 3 GPa.

This is because even if the thickness $t_b$ of the protective layer is decreased in the equation (1), the protective layer having a high elastic modulus $E_b$ enables the above ratio, $\{(t_b \times E_b)/(t_a \times E_a)\}$, to approximate to 1.

It is preferable that the protective layer is made from a material having an elastic modulus equal to or larger than that of the substrate material and is made from a heat-resistant resin. A polyester, a polyether ketone, a polyethylene terephthalate, a polyethersulfone, a polyimide, a polyamide imide, a polyamide, a polybenzimidazole, and a heat-resistant phenol resin can be used as such. Moreover, it is preferable to mix a filler such as carbon black, silica, glass fiber and mica with any of these resin materials to improve the elastic modulus and heat resistance of these materials.

In particular, when a thermoplastic resin is used as the material of the protective layer, the adhesion of the protective layer to the adjacent layer (metal heating layer, releasing layer, or elastic layer) is improved. That is, provision of the thermoplastic resin as the protective layer improves the adhesion of the protective layer to a different kind of metal heating layer, improving durability of the fixing belt. This is thought to be due to the fact that the thermoplastic resin is softened by heat treatment, which improves the adhesion of the protective layer to the adjacent layer and enables these layers to firmly bond to each other.

Such a thermoplastic resin is not limited but a thermoplastic polyimide resin, among thermoplastic resins, is effective in improving the durability of the heating layer. This is because the thermoplastic polyimide resin has higher elastic modulus than most of thermoplastic resins.

There is another reason why the thermoplastic polyimide resin layer is preferable. This reason will be explained. Usually, thermosetting polyimide used for the substrate of the belt or the like has a high elastic modulus and hence can be expected to have a large effect of improving the durability of the heating layer. However, the thermosetting polyimide generates gas at the time of imidization, and therefore it is difficult to apply a thick coating of the thermosetting polyimide. When thermosetting polyimide resin belt having a thickness of about 50 μm to 100 μm is formed as the substrate and the belt is single layer, the gas generated at the time of imidization can be released from the obverse and reverse surfaces of the polyimide resin layer. Thus, a thick film having a thickness of up to about 100 μm can be formed by one application and baking. This can reduce the number of processes and hence manufacturing cost.

However, when the thermosetting polyimide resin layer is formed as the protective layer on the outer peripheral surface of the metal heating layer, it is necessary that the protective layer and the metal heating layer adhere to each other, and therefore the gas generated at the time of imidization is released from only an obverse surface side of the protective layer. Thus, if a thermosetting polyimide resin in which imidization is caused by baking is used in forming such a laminated layer structure, it is difficult to form a thick film by one application and baking.

As described above, it is necessary that the protective layer has an enough thickness to improve the durability of the metal heating layer. Thus, it is preferable to use as the protective layer the thermoplastic polyimide resin layer, in particular, the thermoplastic polyimide resin layer formed by applying a solution in which the thermoplastic polyimide resin that has been completely imidized is dissolved in a solvent, from the viewpoint of the elastic modulus, heat resistance and film forming property.

The thermoplastic resin layer described above can be also provided between the substrate and the metal heating layer, which results in improving the adhesion of layers adjacent to the thermoplastic resin layer, that is, improving the adhesion of the substrate to the metal heating layer and hence further improving durability of the fixing belt.

Here, since the thermoplastic resin layer provided between the substrate and the metal heating layer has a comparatively high elastic modulus, it affects the equations (1) to (3), unlike the releasing layer and the elastic layer which are layers having a low elastic modulus. For this reason, when the thermoplastic resin layer is provided between the substrate and the metal heating layer and has a thickness $T_c$ and an elastic modulus $E_c$, it is preferable that the above equations (1) to (3) are expressed by the following equations (1-a) to (3-a), respectively. Here, the preferable range of the respective equations is the same as that of the respective equations (1) to (3)

$$0.05 \leqq \{[(t_b \times E_b)+(t_c \times E_c)]/(t_a \times E_a)\} \leqq 1 \quad \text{[Equation (1-a)]}$$

$$E_b + E_c \geqq E_a \quad \text{[Equation (2-a)]}$$

$$10 \geqq (t_b + t_c)/t_c \geqq 1 \quad \text{[Equation (3-a)]}$$

[Releasing Layer]

It is preferable that the outermost layer of the heat-fixing belt of the invention is a releasing layer made from a fluorine-containing compound. As will be described later, the releasing layer is formed in order to prevent a fused toner from adhering to the heat-fixing belt when the heat-fixing belt fuses an unfixed toner image and fixes the fused toner image to a recording material. Fluorine-containing rubber and fluororesin such as polytetrafluoroethylene (hereinafter referred to as "PTFE"), perfluoroalkylvinylether copolymer (hereinafter referred to as "PFA"), tetrafluoroethylene-hexafluoropropylene copolymer (hereinafter referred to as "FEP") can be used as the fluorine-containing compound, but the fluorine-containing compound is not limited to these compounds.

The thickness of such a releasing layer is preferably 10 μm to 100 μm, and more preferably 20 μm to 50 μm. If the thickness of the releasing layer is smaller than 10 μm, the releasing layer is worn out by repeated friction caused by the edge of the paper in some cases. On the other hand, if the thickness of the releasing layer is larger than 100 μm, the flexibility of the surface thereof is lost in some cases. As a result, the fixing belt may crush the toner and then graininess of the fixed image may be damaged or the warm-up time may lengthen.

[Elastic Layer]

The fixing belt of the invention may have an elastic layer provided between the substrate and the metal-heating layer. In particular, in order to fix a color image., the fixing belt preferably has the elastic layer. This is because, in the case of a color image, the color image in which four color toners, namely black, magenta, yellow and cyan toners are laminated needs to be fixed on the recording material. That is, in order to obtain a sharp color image, a necessary amount of heat needs to be uniformly supplied to these four laminated color toners to sufficiently fuse the four color toners. If a fixing belt having no elastic layer is used, the fixing belt may crush the laminated toners and hence cannot supply the toner closer to the recording material (that is, the lower layer of the laminated layers) with sufficient heat, thereby degrading color reproduction.

Moreover, even if the fixing belt is used in a fixing device for fixing a monochrome image, the fixing belt preferably has the elastic layer in order to improve printing speed. The reason is as follows. When the fixing belt has the elastic layer, the elastic layer is deformed in a nip region to produce a sufficient nip width even when a load pressed to the fixing device is small. Therefore, sufficient heat can be supplied to the toners even at high speed, which enables fixation of the image on the recording material.

[Manufacturing Method]

A publicly known method can be utilized as a manufacturing method of the fixing belt of the invention. More specifically, for example, the manufacturing method preferably includes a step of forming the protective layer between the metal heating layer and the releasing layer and a heat treatment step of heat-treating the protective layer formed on the metal heating layer at a temperature of 200° C. or more. In particular, when the thermoplastic resin layer is provided between the metal heating layer and the releasing layer, the releasing layer and the elastic layer are formed and then heat treatment is carried out at a temperature of 200° C. or more, whereby the metal heating layer can be firmly bonded to the releasing layer or the elastic layer. As described above, this is because the thermoplastic resin has thermoplasticity and hence is softened at a high temperature to firmly bond the upper and lower layers together.

In this case, when the metal heating layer is made from a metal which is easily oxidized, purging the inside of a heat treatment furnace with inert gas (nitrogen gas, argon gas and the like) makes it possible to firmly bond the upper and lower layers together without degrading heating characteristics.

As to this heat treatment step, adhesion and durability can be sufficiently improved even by a method of heating the belt in an oven such as an electric furnace. However, heat-treating the fixing belt by electromagnetic induction heating not only can improve adhesion and durability but also may make it possible to improve film forming properties. This is because the fixing belt of the invention includes the metal heating layer and hence can be heated by generating an eddy current in the metal heating layer.

Moreover, it is also possible to efficiently heat the metal heating layer by providing a solenoid type coil for generating an alternating magnetic field for the fixing belt and running a high-frequency alternating current through the coil in the heat treatment step. This solenoid type coil can be provided inside the belt or on the outer peripheral surface of the belt. In particular, it is preferable that the solenoid type coil is provided inside the belt. One of the large merits of heat treatment by use of the coil provided inside the belt is to heat the thermoplastic resin layer from inside thereof. In addition, it is also possible to heat the metal heating layer by providing the solenoid type coil near the belt and running a high-frequency alternating current through the coil.

In particular, when the thermoplastic resin layer is formed as the protective layer, it is necessary for the thermoplastic resin layer to have a sufficient thickness. Thus, even if a resin which hardly causes gas to generate, such as a thermoplastic polyimide which has been dissolved in a solvent, is used, it takes time to completely remove the dilution. In the case of an ordinary heat treatment using an oven, heat treatment is conducted after rising an ambient temperature to a temperature necessary for the heat treatment, which results in heating the fixing belt from outside thereof. Thus, the outermost layer of the fixing belt earliest reaches the heat treatment temperature and hence the solvent is earlier removed from the surface side. Therefore, in the case of a thick film, the surface is solidified with the solvent remaining in the innermost portion. When the solvent confined in the innermost portion is evaporated, it cannot be released from the belt and then causes defects such as voids and a crater pattern in some cases.

In the case of heat treatment such as electromagnetic induction heating by generating the eddy current in the metal heating layer to heat the metal heating layer, the metal heating layer can be heated from inside thereof. Therefore, the solvent is removed from the innermost surface of the thermoplastic resin layer. Thus, it is possible to form a thick film having no defects as compared with the heat treatment using the oven. Even in the heat treatment using the oven, it is also possible to reduce defects by gradually rising the internal temperature of the oven and gradually removing the solvent. However, it is possible to more quickly complete heat treatment by use of the electromagnetic induction heat treatment.

A pretreatment step by use of a suitable primer material can be conducted, if necessary, before applying the thermoplastic resin layer to the metal heating layer and/or before applying the elastic layer or the releasing layer to the thermoplastic resin layer, in order to further improve interlayer adhesion.

Moreover, even when the metal heating layer is formed on the thermoplastic resin layer provided on the substrate and then heat treatment is carried out, the adhesive strength can be improved. In particular, when the substrate is made from an insulating heat-resistant resin, it is difficult to ensure adhesion of the metal heating layer to the substrate. Therefore, it is effective to form the thermoplastic resin layer between these layers and to heat-treat it. In addition, when the thermoplastic resin layer is formed on the metal heating layer, electromagnetic induction heating is effective in shortening heat treatment time of the layer formed on the outer surface of the metal heating layer and in removing defects in the layer.

[Electromagnetic Induction Heat-Fixing Device]

FIG. 1 is a schematic cross sectional view of one example of an electromagnetic induction heat-fixing device including the fixing belt of the invention. In FIG. 1, a reference numeral 10 denotes the fixing belt of the invention. The fixing belt 10 includes a substrate 10*a*, a metal heating layer 10*b*, a releasing layer 10*c*, and an additional layer 10*d*, which is formed between the metal heating layer 10*b* and the releasing layer 10*c* and may be either a protective layer or a thermoplastic resin layer. A press roll 11 is arranged such that it is brought into contact with the fixing belt 10, forming a nip therebetween. The press roll 11 is constructed in such a way that an elastic material layer 11*b* made from a silicone rubber or the like is formed on a substrate 11*a* and that a releasing layer 11*c* made from a fluorine-containing compound is formed on the elastic material layer 11*b*.

A press contact member 13 having a nip pad 13*c* made from a rubber or the like, a nip head 13*b* for locally increasing a nip pressure and a support 13*a* is arranged such that it faces the press roll 11 via a part of the fixing belt 10.

Moreover, an electromagnetic induction heating unit 12 in which an electromagnetic induction coil (excitation coil) is built is provided such that it and the press roll 11 sandwich the fixing belt 10. An excitation circuit applies an alternating current to the electromagnetic induction coil and varies magnetic field, which causes the electromagnetic induction heating unit 12 to generate an eddy current in the metal heating layer. The eddy current is converted to heat (joule heat) by electric resistance of the metal heating layer, whereby generating heat in the surface of the fixing belt 10.

In this respect, the electromagnetic induction heating unit 12 can be provided upstream of a rotational direction B with respect to a nip region in the heat-fixing belt 10.

In the electromagnetic induction heat-fixing device, a drive unit (not shown) drives and turns (rotates) the fixing belt 10 in a direction indicated by an arrow B, which causes the press roll 11 to rotate in a direction indicated by an arrow C. A recording material 15 on which an unfixed toner image 14 is formed is conveyed in a direction indicated by an arrow A and passed through the nip of the fixing device, whereby the unfixed toner image 14 is fused and fixed on the recording material 15 by pressure.

Here, in driving the fixing belt, the belt can be driven (rotation of roll accompanies driving the belt) or roll can be driven (rotation of belt accompanies driving the roll).

Figure 2:
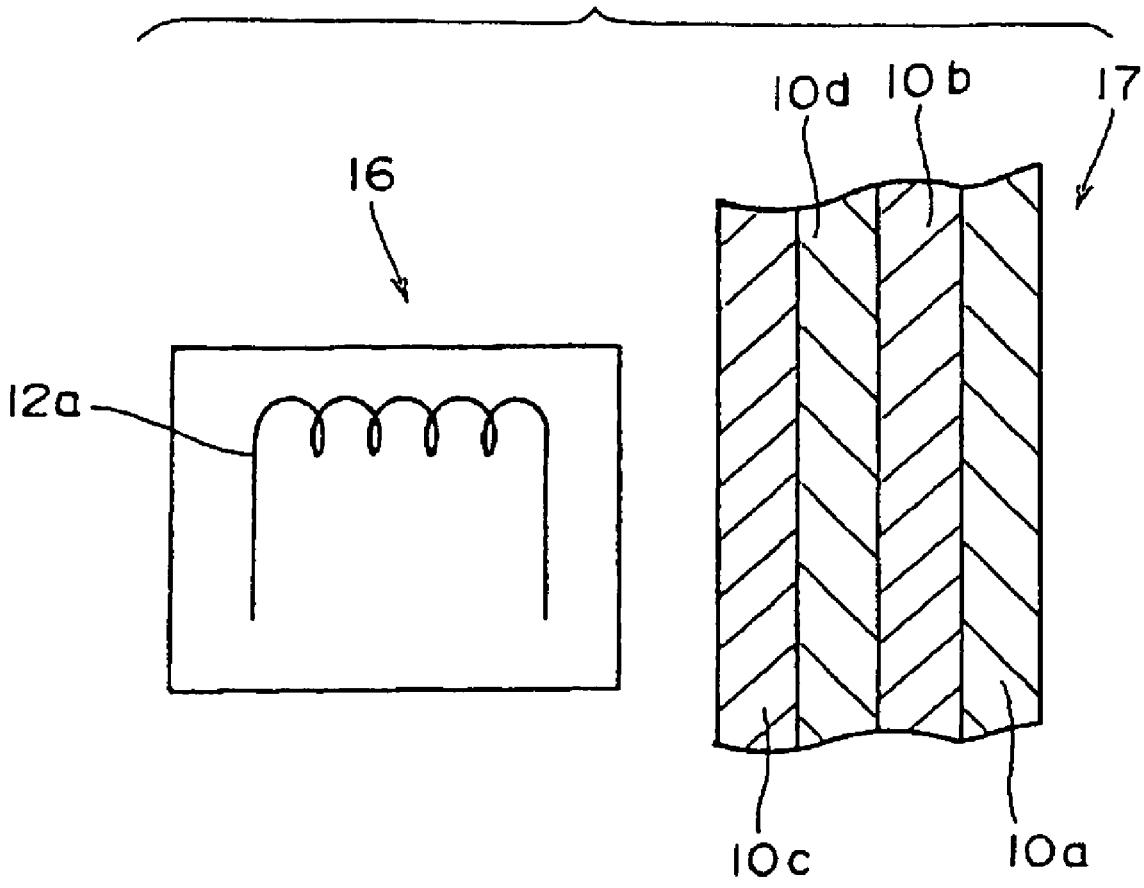
FIG. 2 is an illustration describing the principle of an electromagnetic induction heating method.

FIG. 2 illustrates the principle of an electromagnetic induction heating system. In FIG. 2, a reference numeral 17 illustrates a partial cross sectional view of the fixing belt and a reference numeral 16 illustrates the electromagnetic induction heating unit.

The fixing belt 17 has a metal heating layer 10*b* which is made of a conductive member that generates heat by itself when an electromagnetic induction action is applied thereto and which is formed on the surface of a substrate 10*a*, and a releasing layer 10*c* which is made of a fluorine-containing compound and which is formed on the surface of the metal heating layer 10*b*. A protective layer 10*d*, which may be either a protective layer or a thermoplastic resin layer, is formed between the metal heating layer 10*b* and the releasing layer 10*c*. When the excitation circuit (not shown) applies an alternating current to the electromagnetic induction coil 12*a*, the electromagnetic induction heating unit 16 forms an alternating magnetic field which is substantially perpendicular to the surface of the heat-fixing belt.

The heating principle of the metal heating layer 10*b* by this electromagnetic induction action will be described as follows.

When the alternating current is applied to the electromagnetic induction coil 12*a* by the excitation circuit (not shown), magnetic flux repeatedly appears or disappears around the electromagnetic induction coil 12*a*. When the magnetic flux crosses the metal heating layer 10*b* of the fixing belt 17, an eddy current is generated in the metal heating layer 10*b* so as to generate a magnetic field preventing the magnetic flux from varying. The eddy current and the specific resistance of the metal heating layer 10*b* generate joule heat.

The eddy current mainly passes through the surface of the metal heating layer 10*b* which surface is on the electromagnetic induction heating unit 16 side because of skin effect and electric power proportional to the surface resistance Rs of the metal heating layer 10*b* generates heat. Here, given that angular frequency is ω, permeability is μ, and specific resistance is ρ, a surface depth δ is expressed by the following equation.

$$\delta=(2\rho/\omega\mu)^{1/2}$$

Further, the surface resistance Rs is expressed by the following equation.

$$Rs=\rho/\delta=(\omega\mu\rho/2)^{1/2}$$

Given that a current passing through the fixing belt 17 is Ih, the electric power generated in the metal heating layer 10*b* of the fixing belt 17 is expressed by the following equation.

$$P\propto Rs\int |Ih|^2\, dS$$

Thus, if the surface resistance Rs is increased or the current Ih is increased, the electric power P can be increased and hence the amount of heat can be increased. Here, the surface depth δ (m) is expressed by the following equation by use of the frequency f (Hz) of the excitation circuit, relative permeability μr and the specific resistance ρ (Ωm).

$$\delta=503\ (\rho/(f\mu r))^{1/2}$$

This shows the depth of absorption of an electromagnetic wave used in the electromagnetic induction and the intensity of the electromagnetic wave is equal to or less than 1/e in a portion deeper than the surface depth δ. In other words, almost all energy is absorbed up to the surface depth δ.

Here, it is preferable that the thickness of the metal heating layer 10*b* is larger than the surface depth expressed by the above equation and is 1 μm to 10 μm, Then, if the thickness of the heating layer 16*b* is smaller than 1 μm, the heating layer 16*b* cannot absorb almost all the electromagnetic energy, thereby reducing efficiency.

EXAMPLES

Example 1

An endless belt substrate made of polyimide resin (trade name: U varnish, manufactured by Ube Industries Ltd.) and having a thickness of 70 μm and an outer diameter of 30 mm is subjected to alkali etching, cleaned, and then subjected to nickel electroless plating to form a nickel layer having a thickness of 0.5 μm. Next, a copper layer having a thickness of 10 μm is formed on the nickel layer by using the nickel electroless plating film as an electrode and by conducting electrolytic plating. The copper film is sufficiently cleaned. Polyimide varnish (trade name: U varnish, manufactured by Ube Industries Ltd.) is applied to the copper film so that the thickness thereof is 80 μm. The coating layer is subjected to primary drying in a furnace at a temperature of 100° C. for 30 minutes while it is being rotated. Further, a fluororesin (PFA) dispersion coating (trade name: EN-710CL, manufactured by DuPont-Mitsui fluorochemicals Company, Ltd.) is applied to the polyimide film and the coating layer is left in a furnace purged with nitrogen gas at 380° C. for 1 hour to bake the polyimide film and the fluororesin film at the same time. The fixing belt is thus produced.

The produced fixing belt has the polyimide layer having a thickness of 10 μm and the PFA layer having a thickness of 30 μm.

The protective layer and the substrate are films made of polyimide and having an elastic modulus of 3.1 GPa (310 kgf/mm$^2$).

The product of the thickness $t_b$ and the elastic modulus $E_a$ of the substrate is as follows.

$$(t_a \times E_a) = (70 \times 10^{-6}) \times (3.1 \times 10^9) = 2.17 \times 10^5$$

The product of the thickness $t_b$ and the elastic modulus $E_b$ of the protective layer is as follows.

$$(t_b \times E_b) = (10 \times 10^{-6}) \times (3.1 \times 10^9) = 0.31 \times 10^5$$

Then, the ratio of the product of the thickness and the elastic modulus of the protective layer to the product of the thickness and the elastic modulus of the substrate is as follows.

$$\{(t_b \times E_b)/(t_a \times E_a)\} = 0.14$$

The peel strength between the protective layer and the metal heating layer of this fixing belt is measured. The peel strength is measured by the following method. Slits having a width of 20 mm are formed in the belt, the protective layer in the slits is peeled, and then a force necessary to peel the protective layer from the metal heating layer at a speed of 50 mm/min is measured by a tension test machine. The peel strength between the metal heating layer and the protective layer at this time is 0.23 N/mm. From this test result, it is clear that the peel strength between the protective layer and the releasing layer is also high.

The belt manufactured in this manner is set in the electromagnetic induction heat-fixing device including the press roll, the excitation coil (electromagnetic induction coil), and the press contact member for pressing the fixing belt against the press roll and is evaluated.

The press contact member includes an edge guide and a folder and a rubber pad for pressing. The edge guide has a portion having an outer diameter nearly equal to the inner diameter of the belt and a portion having a diameter larger than the inner diameter of the belt and is fitted on both ends of the belt to regulate movement of the belt in the axial direction. The folder has a diameter smaller than the inner diameter of the belt and a rubber pad mounting portion. The rubber pad is fixed to the rubber pad mounting portion of the folder and this is inserted into the belt and then the edge guide is mounted on the both ends of the belt. The fixing belt, the press roll and the press contact member are arranged such that a part of the fixing belt in a circumferential direction of the fixing belt is brought into contact with the press roll to press a load between the axis of the press roll and the press contact member and to press the rubber pad against the press roll via the belt and to thereby form a nip. Resin (PPS or the like) that does not generate an induced electromotive force when an alternating current is applied thereto and has heat resistance at a fixing temperature is used for the edge guide and the folder.

Moreover, the excitation coil used in the present example is formed by winding a litz wire, which is a bundle of 16 copper wires each having a diameter of 0.5 mm and insulated from each other, such that the excitation coil has a length longer than the length of the belt, a width covering ⅙ to ¼ of the circumference of the belt and a curvature corresponding to the curvature of the belt, which enables a uniform gap between the excitation coil and the fixing belt. Then, the excitation coil is fixed and provided above the belt such that the gap between the excitation coil and the fixing belt is 2 mm. When the excitation circuit applies an alternating current to the excitation coil, a magnetic field is generated around the excitation coil. When the generated magnetic field crosses the heating layer of the fixing belt, an eddy current which generates a magnetic field in a direction canceling the crossing magnetic field is generated by the electromagnetic induction. Then, heat corresponding to the eddy current at this time and the resistance of the heating layer are generated.

The press roll is formed by forming a foam silicone rubber layer having a thickness of 12 mm as an elastic layer on a solid shaft having an outer diameter of 16 mm and by covering the foam silicone rubber layer with a PFA tube having a thickness of 30 μm. More specifically, a fluororesin tube whose inner surface is coated with a primer for adhesion and which has an outer diameter of 50 mm and a length of 340 mm and a thickness of 30 μm and the solid shaft are set in a molding die. Then, liquid foam silicone rubber is injected into a space having a thickness of 2 mm and formed between the fluororesin tube and the solid shaft and heated at 150° C. for 2 hours to vulcanize and cause the silicone rubber to foam. The elastic layer is thus formed.

A motor is connected via a gear to the press roll and the belt is rotated by driving the press roll, whereby the recording material is conveyed.

An evaluation of the fixing belt is performed by passing J paper manufactured by Fuji Xerox Co., Ltd. through the electromagnetic induction heat-fixing device.

Evaluation items include heat generating characteristics, time necessary for the fixing belt to reach a fixing temperature (hereinafter referred to as "warm-up time"), temperature distribution in the belt, and the difference between power factor, which is one of electric characteristics of the belt, before passing the paper and power factor after passing the paper.

Here, the power factor means cos θ of a phase difference θ between current and voltage running through the excitation coil and generated when a high-frequency current is applied to the excitation coil to generate an eddy current in the heating layer of the fixing belt. As the phase difference θ becomes closer to 0, the power factor becomes higher and hence the fixing belt heats more easily.

A test in which 200,000 sheets of paper are caused to pass through the electromagnetic induction heat-fixing device is carried out. When the power factor before the test is set at 1.0, the power factor after the test is 0.96 and little varies. Both of the warm-up times before and after the test are 4 seconds and never varies. In addition, the temperature distribution after the test remains uniform.

Example 2

A copper layer having a thickness of 10 μm is formed on a polyimide endless belt having a thickness of 40 μm and an outer diameter of 30 mm as a substrate in the same manner as in example 1. Then, the copper layer is sufficiently cleaned and a thermoplastic polyimide (trade name: Rika Coat, manufactured by New Japan Chemical Co., Ltd.) is applied to the cleaned copper layer so that the thickness thereof is 40 μm. The resultant is rotated and dried in a furnace at 150° C. and then dried in an oven purged by nitrogen gas at 250° C. The thickness of the polyimide film produced in this manner is 36 μm. Thereafter, a fluororesin dispersion coating (trade name: EN-710CL, manufactured by DuPont-Mitsui Fluorochemicals Company, Ltd.) is applied to the polyimide film and then baked in a furnace purged by nitrogen gas at 380° C. for 1 hour. The thickness of the fluororesin layer is 30 μm.

The elastic modulus of the substrate is 3.1 GPa and the elastic modulus of the protective layer is 2.6 GPa.

The ratio of the product of the elastic modulus and the thickness of the protective layer to the product of the elastic modulus and the thickness of the substrate is obtained in the same manner as in example 1.

Substrate:

$$(t_a \times E_a)=(40\times10^{-6})\times(3.1\times10^{9})=1.24\times10^{5}$$

Protective layer:

$$(t_b \times E_b(36\times10^{-6})\times(2.6\times10^{9})=0.94\times10^{5}$$

Ratio:

$$\{(t_b \times E_b)/(t_a \times E_a)\}=0.75$$

The peel strength between the protective layer and the metal heating layer of this fixing belt is measured. The peel strength is measured by the following method. Slits having a width of 20 mm are formed in the belt, the protective layer in the slits is peeled, and then a force necessary to peel the protective layer from the metal heating layer at a speed of 50 mm/min is measured by a tension test machine. The peel strength between the metal heating layer and the protective layer at this time is 0.38 N/mm. From this test result, it is clear that the peel strength between the protective layer and the releasing layer is also high.

The thus manufactured belt is set in the electromagnetic induction heat-fixing device used in example 1 and a test in which 200,000 sheets of paper are caused to pass through the electromagnetic induction heat-fixing device is conducted. When the power factor before the test is set at 1.0, the power factor after the test is 0.98 and little varies. Both of the warm-up times before and after the test are 5 seconds and never varies. In addition, the temperature distribution after the test remains uniform.

Example 3

A copper layer having a thickness of 10 μm is formed on a polyimide endless belt having a thickness of 60 μm and an outer diameter of 30 mm as a substrate in the same manner as in example 1. Then the copper layer is sufficiently cleaned and polyimide varnish (U varnish) is applied to the cleaned copper layer so that the thickness thereof is 100 μm. The resultant is rotated and dried in a furnace at 150° C. and then dried and baked in an oven purged by nitrogen gas at 340° C. The thickness of the polyimide film is 13 μm. Then, applying, drying and baking the varnish are performed four times to form a polyimide film having a thickness of 60 μm. Thereafter, a fluororesin dispersion coating (EN-710CL) is applied to the polyimide film and then baked in a furnace purged by nitrogen gas at 380° C. for 1 hour. The thickness of the fluororesin layer is 30 μm.

The elastic modulus of the substrate is 3.2 GPa and the elastic modulus of the protective layer is 3.2 GPa.

The ratio of the product of the elastic modulus and the thickness of the protective layer to the product of the elastic modulus and the thickness of the substrate is obtained in the same manner as in example 1.

Substrate:

$$(t_a \times E_a)=(60\times10^{-6})\times(3.2\times10^{9})=1.92\times10^{5}$$

Protective layer:

$$(t_b \times E_b)=(59\times10^{-6})\times(3.2\times10^{9})=1.89\times10^{5}$$

Ratio:

$$\{(t_b \times E_b)/(t_a \times E_a)\}=0.98$$

The peel strength between the protective layer and the metal heating layer of this fixing belt is measured. The peel strength is measured by the following method. Slits having a width of 20 mm are formed in the belt, the protective layer in the slits is peeled, and then a force necessary to peel the protective layer from the metal heating layer at a speed of 50 mm/min is measured by a tension test machine. The peel strength between the metal heating layer and the protective layer at this time is 0.24 N/mm. From this test result, it is clear that the peel strength between the protective layer and the releasing layer is also high.

The thus manufactured belt is set in the electromagnetic induction heat-fixing device used in example 1 and a test in which 200,000 sheets of paper are caused to pass through the electromagnetic induction heat-fixing device is conducted. When the power factor before the test is set at 10, the power factor after the test is also 1.0 and never varies. Both of the warm-up times before and after the test are 8 seconds and never varies. In addition, the temperature distribution after the test remains uniform.

Example 4

A copper layer is formed on a polyimide endless belt in the same manner as in example 3. Then, the copper layer is sufficiently cleaned and a mixture of polyimide varnish (U varnish) and 15 mass % of carbon black is applied to the cleaned copper layer to form a protective layer having a thickness of 30 μm. Thereafter, a fluororesin dispersion coating (EN-710CL) is applied to the polyimide film. The resultant is baked in a furnace purged by nitrogen gas at 380° C. for 1 hour. The thickness of the fluororesin layer is 30 μm.

Here, the type of carbon black which is a filler is not limited, as long as it has a reinforcing effect. Any carbon black that increases reinforcing ability when mixed with a resin or a rubber, such as furnace black, can be used. However, furnace black, such as SAF, ISAF and HAF, is preferably used. Moreover, reinforcing fine particles other than carbon black can be silica. In this example, Diablack A (manufactured by Mitsubishi Chemical Corp.), which is furnace black, more specifically SAF, is used as carbon black.

The elastic modulus of the substrate is 3.1 Gpa. The elastic modulus of the protective layer is increased by including carbon black in the protective layer, and is higher than that of polyimide which does not include a filler and is 6.0 GPa.

The ratio of the product of the elastic modulus and the thickness of the protective layer to the product of the elastic modulus and the thickness of the substrate is obtained in the same manner as in example 1.

Substrate:

$$(t_a \times E_a)=(60\times10^{-1})\times(3.1\times10^{9})=1.86\times10^{5}$$

Protective layer:

$$(t_b \times E_a)=(30\times10^{-6})\times(6.0\times10^{9})=1.80\times10^{6}$$

Ratio:

$$\{(t_b \times E_b)/(t_a \times E_a)\}=0.97$$

The peel strength between the protective layer and the metal heating layer of this fixing belt is measured. The peel strength is measured by the following method. Slits having a width of 20 mm are formed in the belt, the protective layer in the slits is peeled, and then a force necessary to peel the protective layer from the metal heating layer at a speed of 50 mm/min is measured by a tension test machine. The peel strength between the metal heating layer and the protective layer at this time is 0.25 N/mm. From this test result, it is clear that the peel strength between the protective layer and the releasing layer is also high.

The thus manufactured belt is set in the electromagnetic induction heat-fixing device used in example 1 and a test in which 200,000 sheets of paper are caused to pass through the electromagnetic induction heat-fixing device is conducted. When the power factor before the test is set at 1.0, the power factor after the test is also 1.0 and never varies. Both of the warm-up times before and after the test are 4 seconds and never varies. In addition, the temperature distribution after the test remains uniform.

In this example, the same substrate as that used in example 3 is used and a material having a high elastic modulus is applied as the protective layer. From this example, it is clear that use of a material having a high elastic modulus as a protective layer material makes it possible to reduce the thickness of the protective layer without damaging protective property. In other words, in the case where the elastic modulus of the protective layer is high, even if the thickness of the protective layer is reduced, the product of the elastic modulus and the thickness, which product is an important characteristic, of the protective layer can be substantially the same as that of the substrate. As a result, warm-up time can be more shortened than that in example 3.

Example 5

A copper layer having a thickness of 10 μm is formed on a polyimide endless belt having a thickness of 80 μm and an outer diameter of 30 mm as a substrate in the same manner as in example 1. Then, the copper layer is sufficiently cleaned and polyimide varnish (U varnish) is applied to the cleaned copper layer and baked in an oven purged by nitrogen gas at 400° C. to form a protective layer having a thickness of 5 μm. Thereafter, a fluororesin dispersion coating (EN-710CL) is applied to the polyimide film and then baked in a furnace purged by nitrogen gas at 380° C. for 1 hour. The thickness of the fluororesin layer is 30 Sm.

The elastic modulus of the substrate is 3.1 GPa and the elastic modulus of the protective layer is 3.1 GPa.

The ratio of the product of the elastic modulus and the thickness of the protective layer to the product of the elastic modulus and the thickness of the substrate is obtained in the same manner as in example 1.

Substrate:

$$(t_a \times E_a)=(80\times10^{-6})\times(3.1\times10^{9})=2.48\times10^{5}$$

Protective layer:

$$(t_b \times E_b)=(5\times10^{-6})\times(3.1\times10^{9})=0.16\times10^{5}$$

Ratio:

$$\{(t_b \times E_b)/(t_a \times E_a)\}=0.06$$

The peel strength between the protective layer and the metal heating layer of this fixing belt is measured. The peel strength is measured by the following method. Slits having a width of 20 mm are formed in the belt, the protective layer in the slits is peeled, and then a force necessary to peel the protective layer from the metal heating layer at a speed of 50 mm/min is measured by a tension test machine. The peel strength between the metal heating layer and the protective layer at this time is 0.23 N/mm. From this test result, it is clear that the peel strength between the protective layer and the releasing layer is also high.

The thus manufactured belt is set in the electromagnetic induction heat-fixing device used in example 1 and a test in which 200,000 sheets of paper are caused to pass through the electromagnetic induction heat-fixing device is conducted. When the power factor before the test is set at 1.0, the power factor after the test is 0.95 and little varies. Both of the warm-up times before and after the test are 4 seconds and never varies. In addition, the temperature distribution after the test remains uniform.

In this example, the same substrate as that used in example 3 is used and a material having a high elastic modulus is applied as the protective layer. From this example, it is clear that use of a material having a high elastic modulus as a protective layer material makes it possible to reduce the thickness of the protective layer without damaging protective property. In other words, in the case where the elastic modulus of the protective layer is high, even if the thickness of the protective layer is reduced, the product of the elastic modulus and the thickness, which product is an important characteristic, of the protective layer can be substantially the same as that of the substrate. As a result, warm-up time can be more shortened than that in example 3.

Comparative Example 1

A copper layer is formed on a polyimide endless belt in the same manner as in example 1. Then, the copper layer is sufficiently cleaned and fluororesin dispersion paint is applied to the cleaned copper and baked at 340° C. for 1 hour to form a fluororesin film having a thickness of 30 μm.

The peel strength between the metal heating layer and the releasing layer (fluororesin film) of this fixing belt is measured. The peel strength is measured by the following method. Slits having a width of 20 mm are formed in the belt, the releasing layer in the slits is peeled, and then a force necessary to peel the releasing layer from the metal heating layer at a speed of 50 mm/min is measured by a tension test machine. The peel strength between the metal heating layer and the releasing layer at this time is 0.29 N/mm.

The thus manufactured belt is set in the same electromagnetic induction heat-fixing device as in example 1 and a test in which sheets of paper are caused to pass through the electromagnetic induction heat-fixing device is conducted. After about 80,000 sheets of paper pass through the device, a power factor begins to decrease and the temperature at end portions of the belt insufficiently rises, resulting in increased difference between the temperature there and that at other portions of the belt surface. As a result, after 110,000 sheets of paper pass through the device, cold offsetting occurs by an insufficient temperature at the end portions of the fixing belt. Finally, 200,000 sheets of paper are caused to pass through the device to complete the test. When the power factor before the test is set at 1.0, the power factor after the test decreases to 0.75. Then, the warm-up time before the test is 4 seconds, whereas the warm-up time after the test lengthens to 15 seconds.

The measurement results of the above-mentioned tests are shown in Table 1.

and then subjected to nickel electroless plating to form a nickel layer having a thickness of 0.5 μm. Next, a copper layer having a thickness of 10 μm is formed on the nickel layer by using the nickel electroless plating film as an electrode and by conducting electrolytic plating. The copper film is sufficiently cleaned. Thermoplastic polyimide varnish (trade name: Rika Coat SN20, manufactured by New Japan Chemical Co., Ltd.) which has been completely imidized and is dissolved in a solvent is applied to the copper film so that the thickness thereof is 300 μm. The resultant is rotated and dried in a furnace purged by nitrogen gas at 200° C. for 60 minutes to form a thermoplastic resin layer having a thickness of 60 μm.

Further, a liquid silicone rubber is applied via a primer to the thermoplastic resin layer to form an elastic layer having a thickness of 300 μm and the elastic layer is vulcanized and then coated with a heat-resistant primer (Teflon (R) primer 855-021, manufactured by DuPont Co., Ltd., water paint) and then coated with PFA dispersion paint (500CL, manufactured by DuPont Co., Ltd., water paint). The resultant is baked at 380° C. to form a releasing layer having a thickness of 30 μm.

TABLE 1

| | | Example 1 | Example 2 | Example 3 | Example 4 | Example 5 | Comparative Example 1 |
|---|---|---|---|---|---|---|---|
| Substrate | Material | U varnish | U varnish | U varnish | U varnish | U varnish | U varnish |
| | Thickness(μm) | 70 | 40 | 60 | 60 | 80 | 70 |
| | Elastic modulus (GPa) | 3.1 | 3.1 | 3.2 | 3.1 | 3.1 | 3.1 |
| | Elastic modulus × thickness (Pa · m) | $2.17 \times 10^5$ | $1.24 \times 10^5$ | $1.92 \times 10^5$ | $1.86 \times 10^5$ | $2.48 \times 10^5$ | $2.17 \times 10^5$ |
| Metal heating layer | Material | Copper plating | Copper plating | Copper plating | Copper plating | Copper plating | Copper plating |
| | Thickness(μm) | 10 | 10 | 10 | 10 | 10 | 10 |
| Protective layer | Material | U varnish | Rika coat | U varnish | U varnish | U varnish | Nothing |
| | Thickness(μm) | 10 | 36 | 59 | 30 | 5 | — |
| | Elastic modulus (GPa) | 3.1 | 2.6 | 3.2 | 6 | 3.1 | — |
| | Elastic modulus × thickness (Pa · m) | $3.10 \times 10^4$ | $9.36 \times 10^4$ | $1.89 \times 10^4$ | $1.80 \times 10^4$ | $1.55 \times 10^4$ | — |
| Releasing layer | Material | Fluororesin | Fluororesin | Fluororesin | Fluororesin | Fluororesin | Fluororesin |
| | Thickness(μm) | 30 | 30 | 30 | 30 | 30 | 30 |
| | Ratio *2 | 0.14 | 0.75 | 0.98 | 0.97 | 0.06 | — |
| Measurement results | Power factor after causing sheets of paper to pass through the device | 0.96 | 0.98 | 1 | 1 | 0.95 | 0.75 after 80,000 sheets of paper have passed |
| | Warm-up time (sec) | 4 → 4 | 5 → 5 | 8 → 8 | 4 → 4 | 4 → 4 | 4 → 15 |
| | Temperature distribution | Uniform | Uniform | Uniform | Uniform | Uniform | *1 |
| | Image quality after causing sheets of paper to pass through the device | Good | Good | Good | Good | Good | Cold offsetting after 110,00 sheets of paper have passed |
| | Peel strength (N/mm) *3 | 0.23 | 0.38 | 0.24 | 0.25 | 0.23 | 0.29 |

*1 The temperature at end portions of the belt decreases.
*2 Ratio in the table shows (elastic modulus × thickness of protective layer)/(elastic modulus × thickness of substrate).
*3 peel strength in the table shows the peel strength between the protective layer and the metal heating layer. However, in comparative examples 1, it shows the peel strength between the releasing layer and the metal heating layer.

It can be seen from the measurement results shown in Table 1 that, in the electromagnetic induction heat-fixing device using the fixing belt of the invention in which the protective layer is provided, even after 200,000 sheets of paper pass through the device, warm-up time does not change and temperature distribution remains uniform and image quality remains good.

Example 6

An endless belt substrate made of polyimide resin (trade name: U varnish S, manufactured by Ube Industries Co., Ltd.) and having an outter diameter of 30 mm and a thickness of 70 μm is subjected to alkali etching, cleaned, The elastic modulus of the substrate is 3.1 GPa and the elastic modulus of the protective layer (thermoplastic resin layer) is 2.6 GPa.

The ratio of the product of the elastic modulus and the thickness of the protective layer to the product of the elastic modulus and the thickness of the substrate is obtained in the same manner as in example 1.

Substrate:

$$(t_a \times E_a) = (70 \times 10^{-6}) \times (3.1 \times 10^9) = 2.17 \times 10^5$$

Protective layer (thermoplastic resin layer):

$$(t_b \times E_b) = (60 \times 10^{-6}) \times (2.6 \times 10^9) = 1.56 \times 10^5$$

Ratio:

$$\{(t_b \times E_b)/(t_a \times E_a)\}=0.72$$

The peel strength between the protective layer and the metal heating layer of this fixing belt is measured. The peel strength is measured by the following method. Slits having a width of 20 mm are formed in the belt, the protective layer in the slits is peeled, and then a force necessary to peel the protective layer from the metal heating layer at a speed of 50 mm/min is measured by a tension test machine. The peel strength between the metal heating layer and the protective layer at this time is 0.30 N/mm. From this test result, it is clear that the peel strength between the protective layer and the elastic layer is also high.

The thus manufactured fixing belt is set in the same electromagnetic induction heat-fixing device as in example 1 and a test in which 200,000 sheets of paper are caused to pass through the electromagnetic induction heat-fixing device is conducted. Evaluation items include heat generating characteristics, temperature distribution in the belt, the difference between power factor, which is one of electric characteristics of the belt, before the test and power factor after the test, and the presence or absence of peeling between the respective layers.

As the results of the test of causing paper to pass through the device, peeling does not occur at the interface between the polyimide resin layer and the metal heating layer (heating layer). Moreover, as in example 1, when the power factor before the test is set at 1.0, the power factor after the test is 0.98 and little varies. Both of the warm-up times before and after the test are 14 seconds and never varies. In addition, the temperature distribution after the test remains uniform and the image quality is good.

Example 7

The surface of an endless belt substrate made of a polyimide resin (trade name: U varnish S, manufactured by Ube Industries Co., Ltd.) and having an outer diameter of 30 mm and a thickness of 60 μm is roughened by sandblasting with alumina abrasive grains #400, cleaned and then subjected to nickel electroless plating to form a nickel layer having a thickness of 0.5 μm. Next, a copper layer (metal heating layer) having a thickness of 10 μm is formed thereon by using the nickel electroless plating film as an electrode and by conducting electrolytic plating. Then, the copper layer is sufficiently cleaned and coated with thermoplastic polyimide varnish (trade name: Rika Coat SN20, manufactured by New Japan Chemical Co., Ltd.) which has been completely imidized and is dissolved in a solvent so that the thickness of the polyimide layer is 200 μm. Next, resin flange jigs each having an outer diameter nearly equal to the inner diameter of the resultant belt precursor are mounted on both ends of the belt precursor. Rotational driving force from a motor is transmitted to the resin flange jigs mounted on both ends of the belt precursor to turn the belt precursor. While the polyimide varnish is prevented from dropping, an alternating current is caused to run through a solenoid type coil placed in the belt precursor at power of 800 watts to induction-heat the belt precursor until the surface temperature of the belt precursor reaches 150° C. Then, the belt precursor is turned in this state for 30 minutes to complete initial drying and is removed from the jig for rotation. Thereafter, the belt precursor is induction-heated to 250° C. at power of 1,000 watts to completely remove dilution. A thermoplastic resin layer having a thickness of 40 μm is thus formed.

A liquid silicone rubber is applied to the thermoplastic resin layer via primer to form an elastic layer having a thickness of 300 μm and the elastic layer is subjected to primary vulcanizing and then a heat-resistant primer (Teflon (R) primer 855-021, manufactured by DuPont Co., Ltd. water paint) is applied to the elastic layer. The primer layer is covered with a PFA tube having a thickness of 30 μm. The resultant is heat-treated in a furnace purged by nitrogen gas at 250° C. for 30 minutes for the purpose of subjecting the silicone rubber to secondary vulcanizing and baking the heat-resistant primer.

The elastic modulus of the substrate is 3.1 GPa and the elastic modulus of the protective layer (thermoplastic resin layer) is 2.6 GPa.

The ratio of the product of the elastic modulus and the thickness of the protective layer to the product of the elastic modulus and the thickness of the substrate is obtained in the same manner as in example 1.

Substrate:

$$(t_a \times E_a)=(60\times10^{-6})\times(3.1\times10^{9})=1.86\times10^{5}$$

Protective layer (thermoplastic resin layer):

$$(t_b \times E_b)=(40\times10^{-6})\times(2.6\times10^{9})=1.04\times10^{5}$$

Ratio:

$$\{(t_b \times E_b)/(t_a \times E_a)\}=0.56$$

The peel strength between the protective layer and the metal heating layer of this fixing belt is measured. The peel strength is measured by the following method. Slits having a width of 20 mm are formed in the belt, the protective layer in the slits is peeled, and then a force necessary to peel the protective layer from the metal heating layer at a speed of 50 mm/min is measured by a tension test machine. The peel strength between the metal heating layer and the protective layer at this time is 0.35 N/mm. From this test result, it is clear that the peel strength between the elastic layer and the protective layer is also high.

The thus manufactured fixing belt is set in the same electromagnetic induction heat-fixing device as in example 1 and a test in which 200,000 sheets of paper are caused to pass through the electromagnetic induction heat-fixing device is conducted. Evaluation items include heat generating characteristics, temperature distribution in the belt, the difference between power factor, which is one of electric characteristics of the belt, before the test and power factor after the test, and the presence or absence of peeling between the respective layers.

As the results of the test of causing paper to pass thourh the device, peeling does not occur at the interface between the polyimide resin layer and the metal heating layer (heating layer). Moreover, as in example 1, when the power factor before the test of causing paper to pass through the device is set at 1.0, the power factor after the test is 0.96 and little varies. Both of the warm-up times before and after the test are 13 seconds and never varies. In addition, the temperature distribution after the test remains uniform and the image quality is good.

Comparative Example 2

A fixing belt is manufactured in the same manner as in example 6 except that the thermoplastic polyimide is not applied to the metal heating layer but the heat-resistant primer and PFA dispersion paint are directly applied thereto and baked. The fixing belt is evaluated in the same manner as in example 6.

The peel strength between the metal heating layer and the elastic layer of this fixing belt is measured. The peel strength is measured by the following method. Slits having a width of 20 mm are formed in the belt, the elastic layer in the slits is peeled, and then a force necessary to peel the elastic layer from the metal heating layer at a speed of 50 mm/min is measured by a tension test machine. The peel strength between the metal heating layer and the elastic layer at this time is 0.31 N/mm.

The thus manufactured fixing belt is set in the same electromagnetic induction heat-fixing device as in example 1 and a test in which 200,000 sheets of paper are caused to pass through the electromagnetic induction heat-fixing device is conducted. Evaluation items include heat generating characteristics, temperature distribution in the belt, the difference between power factor, which is one of electric characteristics of the belt, before the test and power factor after the test, and the presence or absence of peeling between the respective layers.

As the results of the test of causing paper to pass through the device, peeling occurs at the interface between the elastic layer and the metal heating layer (heating layer). Moreover, a power factor begins decreasing after about 80,000 sheets of paper pass. The power factor is set at 1 before the test, but, when 200,000 sheets of paper have passed, it decreases to 0.75. At this time, the temperature distribution is not uniform in the axial direction and in particular, heat is not sufficiently generated at both ends of the belt, which results in nonuniformity in temperature. For this reason, cold offsetting occurs at the ends of the belt. Further, the warm-up time before the test is 12 seconds, whereas the warm-up time after the test drastically lengthens to 28 seconds.

Example 8

The surface of an endless belt substrate made of a polyimide resin (trade name: U varnish S, manufactured by Ube Industries Co., Ltd.) and having an outer diameter of 30 mm and a thickness of 60 μm is roughened by sandblasting with alumina abrasive grains #400. Thermoplastic polyimide varnish (trade name: Rika coat SN20, manufactured by New Japan Chemical Co., Ltd.) which has been completely imidized and is dissolved in a solvent is applied to the substrate so that the thickness thereof is 50 μm and then dried in a furnace purged by nitrogen gas at 200° C. for 60 minutes while it is being rotated. A thermoplastic resin layer having a thickness of 10 μm is thus obtained.

The resultant is cleaned and then subjected to nickel electroless plating to form a nickel layer having a thickness of 0.5 μm. Next, a copper layer (metal heating layer) having a thickness of 10 μm is formed on the nickel layer by using the nickel nonelectroless plating film as an electrode and by conducting electrolytic plating.

Then, the copper layer is sufficiently cleaned and thermoplastic polyimide varnish (trade name: Rika Coat SN20, manufactured by New Japan Chemical Co., Ltd.) which has been completely imidized and is dissolved in a solvent is applied to the copper layer and dried in a furnace purged by nitrogen gas at 200° C. for 60 minutes while it is being rotated, A thermoplastic resin layer having a thickness of 50 μm is thus formed.

Next, a liquid silicone rubber is applied via a primer to the thermoplastic resin layer to form an elastic layer having a thickness of 300 μm and is subjected to primary vulcanizing. A heat-resistant primer (Teflon (R) primer 855-021, manufactured by DuPont Co., Ltd., water paint) is applied to the elastic layer and the resultant layer is covered with a PFA tube having a thickness of 30 μm. This is heat-treated in a furnace purged by nitrogen gas at 250° C. for 30 minutes for the purpose of subjecting the silicone rubber to secondary vulcanizing and baking the heat-resistant primer.

The elastic modulus of the substrate is 3.1 GPa. The elastic modulus of the thermoplastic resin layer between the substrate and the metal heating layer is 2.6 GPa. The elastic modulus of the protective layer (thermoplastic resin layer) between the elastic layer and the metal heating layer is 2.6 GPa.

The ratio of the product of the elastic modulus and the thickness of the protective layer (thermoplastic resin layer) including the thermoplastic resin layer between the substrate and the metal heating layer to the product of the elastic modulus and the thickness of the substrate is obtained in the same manner as in example 1.

Substrate:

$$(t_a \times E_a)=(60\times10^{-6})\times(3.1\times10^{9})=1.86\times10^{5}$$

Thermoplastic resin layer between the substrate and the metal heating layer:

$$(t_c \times E_c)=(10\times10^{-6})\times(2.6\times10^{9})=0.26\times10^{5}$$

Protective layer (thermoplastic resin layer) between the elastic layer and the metal heating layer:

$$(t_b \times E_b)=(50\times10^{-6})\times(2.6\times10^{9})=1.30\times10^{5}$$

Ratio:

$$\{[(t_b \times E_b)+(t_c \times E_c)]/(t_a \times E_a)\}=0.61$$

The peel strength between the protective layer on the outer periphery of the metal heating layer and the metal heating layer of this fixing belt is measured. The peel strength is measured by the following method. Slits having a width of 20 mm are formed in the belt, the protective layer in the slits is peeled, and then a force necessary to peel the protective layer from the metal heating layer at a speed of 50 mm/min is measured by a tension test machine. The peel strength between the metal heating layer and the protective layer at this time is 0.41 N/mm. From this test result, it is clear that the peel strength between the protective layer and the elastic layer is also high.

Similarly, the peel strength between the thermoplastic resin layer on the inner periphery of the metal heating layer and the metal heating layer is measured. The peel strength between the thermoplastic resin layer and the metal heating layer is 0.31 N/mm.

The thus manufactured fixing belt is set in the same electromagnetic induction heat-fixing device as in example 1 and a test in which 200,000 sheets of paper are caused to pass through the electromagnetic induction heat-fixing device is conducted. Evaluation items include heat generating characteristics, temperature distribution in the belt, the difference between power factor, which is one of electric characteristics of the belt, before the test and power factor after the test, and the presence or absence of peeling between the respective layers.

As the results of the test of causing paper to pass through the device, peeling does not occur at the interface between the polyimide resin layer and the metal heating layer (heating layer). Moreover, as in example 1, when the power factor before the test of causing paper to pass through the device is set at 1.0, the power factor after the test is 0.96 and little varies. Both of the warm-up times before and after the test are 13 seconds and never varies. In addition, the temperature distribution after the test remains uniform and the image quality is good.

Comparative Example 3

A fixing belt is manufactured in the same manner as in example 8 except that the thermoplastic polyimide is not applied to the substrate but the substrate is directly plated and that the thermoplastic polyimide is not applied to the metal heating layer but the elastic layer is formed on the metal heating layer via a primer. The fixing belt is evaluated in the same manner as in example 8.

The peel strength between the metal heating layer and the elastic layer of this fixing belt is measured. The peel strength is measured by the following method. Slits having a width of 20 mm are formed in the belt, the elastic layer in the slits is peeled, and then a force necessary to peel the elastic layer from the metal heating layer at a speed of 50 mm/min is measured by a tension test machine. The peel strength between the metal heating layer and the elastic layer at this time is 0.30 N/mm.

Similarly, the peel strength between the substrate and the metal heating layer is measured. The peel strength between the substrate and the metal heating layer is 0.21 N/mm.

The thus manufactured fixing belt is set in the same electromagnetic induction heat-fixing device as in example 1 and a test in which 200,000 sheets of paper are caused to pass through the electromagnetic induction heat-fixing device is conducted. Evaluation items include heat generating characteristics, temperature distribution in the belt, the difference between power factor, which is one of electric characteristics of the belt, before the test and power factor after the test, and the presence or absence of peeling between the respective layers.

As the results of the test of causing paper to pass through the device, peeling occurs at the interface between the elastic layer and the metal heating layer (heating layer). Moreover, the power factor begins to decrease after about 80,000 sheets of paper pass. The power factor is set at 1 before the test, but, when 200,000 sheets of paper have passed, it decreases to 0.75. At this time, the temperature distribution is not uniform in the axial direction and in particular, heat is not sufficiently generated at both ends of the belt, which results in nonuniformity in temperature. For this reason, cold offseting occurs at the ends of the belt. Further, the warm-up time before the test is 12 seconds, whereas the warm-up time after the test drastically lengthens to 27 seconds.

The test results are shown in Table 2.

TABLE 2

| | | Example 6 | Example 7 | Comparative Example 2 | example 8 | Comparative Example 3 |
|---|---|---|---|---|---|---|
| Substrate | Material | U varnish | U varnish | U varnish | U varnish | U varnish |
| | Thickness(μm) | 70 | 60 | 70 | 60 | 60 |
| | Elastic modulus (GPa) | 3.1 | 3.1 | 3.1 | 3.1 | 3.2 |
| | Elastic modulus × thickness (Pa · m) | $2.17 \times 10^5$ | $1.86 \times 10^5$ | $2.17 \times 10^5$ | $1.86 \times 10^5$ | $1.92 \times 10^5$ |
| Thermoplastic resin layer | Material | — | — | — | Rika Coat | — |
| | Thickness(μm) | — | — | — | 10 | — |
| | Elastic modulus (GPa) | — | — | — | 2.6 | — |
| | Elastic modulus × thickness (Pa · m) | — | — | — | $0.26 \times 10^5$ | — |
| Metal heating layer | Material | Copper plating | Copper plating | Copper plating | Copper plating | Copper plating |
| | Thickness(μm) | 10 | 10 | 10 | 10 | 10 |
| Protective layer | Material | Rika Coat | Rika Coat | — | Rika Coat | — |
| | Thickness(μm) | 60 | 40 | — | 50 | — |
| | Elastic modulus (GPa) | 2.6 | 2.6 | — | 2.6 | — |
| | Elastic modulus × thickness (Pa · m) | $1.56 \times 10^5$ | $1.04 \times 10^5$ | — | $1.30 \times 10^5$ | — |
| Elastic layer | Material | Silicone rubber | Silicone rubber | Silicone rubber | Silicone rubber | Silicone rubber |
| | Thickness(μm) | 300 | 300 | 300 | 300 | 300 |
| Releasing layer | Material | Fluororesin | Fluororesin | Fluororesin | Fluororesin | Fluororesin |
| | Thickness(μm) | 30 | 30 | 30 | 30 | 30 |
| | Ratio | 0.72 | 0.56 | — | 0.61 | — |
| Measurement results | Power factor after passing sheets of paper | 0.98 | 0.96 | 0.75 | 0.96 | 0.75 |
| | warm-up time (sec) | 14 → 14 | 13 → 13 | 12 → 28 | 13 → 13 | 12 → 27 |
| | Temperature distribution after causing sheets of paper to pass through the device | Uniform | Uniform | *1 | Uniform | *1 |
| | Image quality after causing sheets of paper to pass through the device | Good | Good | Cold offsetting at end portions | Good | Cold offsetting at end portions |
| | Peel strength (N/mm) | 0.30 | 0.35 | 0.31 | 0.41(0.31) | 0.30(0.21) |

*1 The temperature at end portions of the belt decreases.

*2 Ratio in the table shows (elastic modulus × thickness of protective layer)/(elastic modulus × thickness of substrate). However, ratio in example 8 shows {(elastic modulus × thickness of protective layer) + (elastic modulus × thickness of thermoplastic resin layer)}/(elastic modulus × thickness of substrate).

*3 Peel strength in the table shows the peel strength between the protective layer and the metal heating layer. The number in the parenthesis shows the peel strength between the thermoplastic resin layer and the metal heating layer. However, values in comparative examples 2 and 3 are the peel strengths between the elastic layer and the metal heating layer. The number in the parenthesis shows the peel strength between the substrate and the metal heating layer.

As shown in Tables 1 and 2, from the results of the example 2, examples 6 to 8 and the comparative example 6, it is clear that forming the thermoplastic polyimide resin layer as the protective layer can more effectively and more compatibly prevent cracks from being caused by mechanical stress and shorten the warm-up time and at the same time can improve the adhesion of the metal heating layer without peeling at the interface between the layers. In particular, it is clear in the example 8 in which the thermoplastic polyimide layer is provided between the substrate and the metal heating layer that the peel strength between the substrate and the metal heating layer is improved and that in turn durability is improved.

Moreover, since the thermoplastic resin layer is formed by use of thermoplastic polyimide resin, particularly, thermoplastic polyimide resin which has been completely imidized and is dissolved in a solvent, a thick layer can be formed by one application and baking. Therefore, it is understood that this can reduce the number of processes and hence realize cost reduction.

What is claimed is:

1. A fixing belt comprising a substrate having provided thereon at least a metal heating layer and a releasing layer, wherein at least a protective layer is provided between the metal heating layer and the releasing layer, wherein a thickness $t_a$ of the substrate, an elastic modulus $E_a$ of the substrate, a thickness $t_b$ of the protective layer, and an elastic modulus $E_b$ of the protective layer satisfy the following equation (1)

$$0.05 \leqq \{(t_b \times E_b)/(t_a \times E_a)\} \leqq 1 \quad (1).$$

2. A fixing belt of claim 1, wherein the substrate is made from a heat-resistant resin.

3. A fixing belt of claim 1, wherein the substrate is made from a polyimide.

4. A fixing belt of claim 1, wherein the protective layer is a thermoplastic resin layer.

5. A fixing belt of claim 1, wherein an elastic layer is provided between the protective layer and the releasing layer.

6. A fixing belt of claim 1, wherein a thermoplastic resin layer is provided between the substrate and the metal heating layer.

7. A fixing belt of claim 1, wherein a thermoplastic polyimide layer is provided between the substrate and the metal heating layer.

8. A fixing belt of claim 1, further comprising a coil for generating an alternating magnetic field in the belt.

9. A fixing belt comprising a substrate having provided thereon at least a metal heating layer and a releasing layer, wherein at least a protective layer is provided between the metal heating layer and the releasing layer, wherein the elastic modulus $E_a$ of the substrate and the elastic modulus $E_b$ of the protective layer satisfy the following equation (2)

$$E_b \geqq E_a \quad (2).$$

10. A fixing belt comprising a substrate having provided thereon at least a metal heating layer and a releasing layer, wherein at least a protective layer is provided between the metal heating layer and the releasing layer, wherein the thickness $t_b$ of the protective layer and the thickness $t_c$ of the metal heating layer satisfy the following equation (3)

$$10 \geqq t_b/t_c \geqq 1 \quad (3).$$

11. A fixing belt comprising a substrate having provided thereon at least a metal heating layer and a releasing layer, wherein at least a protective layer is provided between the metal heating layer and the releasing layer, wherein the protective layer is a thermoplastic polyimide resin layer.

12. A fixing belt comprising a substrate having provided thereon at least a metal heating layer and a releasing layer, wherein at least a protective layer is provided between the metal heating layer and the releasing layer, wherein the protective layer is a thermoplastic polyimide resin layer formed by applying a solution of a thermoplastic polyimide resin in a state where it has been completely imidized.

13. A fixing belt comprising a substrate having provided thereon at least a metal heating layer and a releasing layer, wherein at least a protective layer is provided between the metal heating layer and the releasing layer, wherein a thermoplastic resin layer formed by applying a solution of a thermoplastic polyimide resin in a state where it has been completely imidized is provided between the substrate and the metal heating layer; and wherein a thickness $t_a$ of the substrate, an elastic modulus $E_a$ of the substrate, a thickness $t_b$ of the protective layer, and an elastic modulus $E_b$ of the protective layer satisfy the following equation (1)

$$0.05 \leqq \{(t_b \times E_b)/(t_a \times E_a)\} \leqq 1 \quad (1).$$

14. An electromagnetic induction heat-fixing device comprising:

a fixing belt comprising a substrate having provided thereon at least a metal heating layer and a releasing layer;

a press roll that abuts against the fixing belt to form a nip and rotates;

a press contact member for increasing a nip pressure; and an excitation coil, wherein an eddy current is generated in the metal heating layer, which is included in the fixing belt, by a magnetic field generated by running an electrical current through the excitation coil to heat a surface of the metal heating layer, and a recording material having an unfixed toner image formed thereon is passed through the nip in such a way that the unfixed toner image abuts against the fixing belt to fuse the unfixed toner image and fix the image to the recording material by pressure, and wherein the fixing belt has at least a protective layer provided between the metal heating layer and the releasing layer, and wherein the elastic modulus $E_b$ of the protective layer is 2 GPa or more; and wherein a thickness $t_a$ of the substrate, an elastic modulus $E_a$ of the substrate, a thickness $t_b$ of the protective layer, and an elastic modulus $E_b$ of the protective layer satisfy the following equation (1)

$$0.05 \leqq \{(t_b \times E_b)/(t_a \times E_a)\} \leqq 1 \quad (1).$$

15. A method of manufacturing a fixing belt comprising a substrate having provided thereon at least a metal heating layer and a releasing layer, the method comprising:

forming a protective layer between the metal heating layer and the releasing layer; and heat-treating the protective layer at a temperature of 200° C. or more, wherein a thickness $t_a$ of the substrate, an elastic modulus $E_a$ of the substrate, a thickness $t_b$ of the protective layer, and an elastic modulus $E_b$ of the protective layer satisfy the following equation (1).

$$0.05 \leqq \{(t_b \times E_b)/(t_a \times E_a)\} \leqq 1 \quad (1).$$

16. A method of manufacturing a fixing belt of claim 15, wherein the heat treatment step involves running a high-frequency current for generating an alternating magnetic field in a coil arranged near the fixing belt so as to generate an eddy current in the fixing belt's metal heating layer, thereby heating the protective layer to 200° C. or more by electromagnetic induction heating.

17. A method of manufacturing a fixing belt of claim 15, wherein the fixing belt has a coil for generating an alternating magnetic field and the heat treatment step involves running a high-frequency current for generating an alternating magnetic field in the coil so as to generate an eddy current in the fixing belt's metal heating layer, thereby heating the protective layer to 200° C. or more by electromagnetic induction heating.

18. A fixing belt comprising a substrate having provided thereon at least a metal heating layer and a releasing layer, wherein at least a thermoplastic resin layer is provided between the substrate and the metal heating layer, and wherein the thermoplastic resin layer is a thermoplastic polyimide resin layer formed by applying a solution of a thermoplastic polyimide resin in a state where it has been completely imidized; and wherein a thickness $t_a$ of the substrate, an elastic modulus $E_a$ of the substrate, a thickness $t_b$ of the protective layer, and an elastic modulus $E_b$ of the protective layer satisfy the following equation (1)

$$0.05 \leqq \{(t_b \times E_b)/(t_a \times E_a)\} \leqq 1 \quad (1).$$

19. A fixing belt of claim 18, wherein an elastic layer is provided between the protective layer and the releasing layer.

20. A fixing belt of claim 18, wherein the thermoplastic resin layer is a thermoplastic polyimide layer.

21. A fixing belt of claim 18, wherein the fixing belt has a coil for generating an alternating magnetic field.

22. A method of manufacturing a fixing belt comprising a substrate having provided thereon at least a metal heating layer and a releasing layer, the method comprising:

forming a thermoplastic resin layer between the substrate and the metal heating layer; and heat-treating the protective layer at a temperature of 200° C. or more, wherein a thickness $t_a$ of the substrate, an elastic modulus $E_a$ of the substrate, a thickness $t_b$ of the thermoplastic resin layer, and an elastic modulus $E_b$ of the thermoplastic resin layer satisfy the following equation (1)

$$0.05 \leqq \{(t_b \times E_b)/(t_a \times E_a)\} \leqq 1 \quad (1).$$

23. A method of manufacturing a fixing belt of claim 22, wherein the heat treatment step involves running a high-frequency current for generating an alternating magnetic field in a coil arranged near the fixing belt so as to generate an eddy current in the fixing belt's metal heating layer, thereby heating the protective layer to 200° C. or more by electromagnetic induction heating.

24. A method of manufacturing a fixing belt of claim 22, wherein the fixing belt has a coil for generating an alternating magnetic field and the heat treatment step involves running a high-frequency current for generating an alternating magnetic field in the coil so as to generate an eddy current in the fixing belt's metal heating layer, thereby heating the protective layer to 200° C. or more by electromagnetic induction heating.

* * * * *